US009537255B2

(12) United States Patent
Yoshigi et al.

(10) Patent No.: US 9,537,255 B2
(45) Date of Patent: Jan. 3, 2017

(54) CONNECTOR FITTING STRUCTURE

(71) Applicant: Yazaki Corporation, Minato-ku, Tokyo (JP)

(72) Inventors: Toshimasa Yoshigi, Makinohara (JP); Hironaga Iwamoto, Fujieda (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 14/481,236

(22) Filed: Sep. 9, 2014

(65) Prior Publication Data

US 2015/0072550 A1 Mar. 12, 2015

(30) Foreign Application Priority Data

Sep. 10, 2013 (JP) ..... 2013-186987

(51) Int. Cl.
*H01R 13/52* (2006.01)
*H01R 13/623* (2006.01)

(52) U.S. Cl.
CPC ..... *H01R 13/623* (2013.01); *H01R 13/5219* (2013.01)

(58) Field of Classification Search
CPC .... H01R 13/5219; H01R 27/00; H01R 13/622
USPC ..... 439/271, 218, 320
See application file for complete search history.

(56) References Cited

U.S. PATENT DOCUMENTS 7,338,306 B1 3/2008 Chen
8,573,853 B2 * 11/2013 Ordo ..... H01R 13/506 385/53
2003/0100213 A1 5/2003 Yoshigi et al.
2004/0038578 A1 * 2/2004 Weigel ..... H01R 13/622 439/320
2004/0175987 A1 * 9/2004 Itoh ..... H01R 13/5219 439/544

(Continued)

FOREIGN PATENT DOCUMENTS

CN 1407666 A 4/2003
JP 2003-163056 A 6/2003

OTHER PUBLICATIONS

Communication dated Apr. 5, 2016, issued by the State Intellectual Property Office of the P.R.C. in corresponding Chinese Application No. 201410459045.5.

*Primary Examiner* — Abdullah Riyami
*Assistant Examiner* — Thang Nguyen
(74) *Attorney, Agent, or Firm* — Sughrue Mion, PLLC

(57) ABSTRACT

A connector fitting structure includes a female connector without a rotating member and an elastic sealing part arranged on the female member. The female connector is configured so as to be engageable with a male connector having a guide groove formed for the rotating member. The male connector is provided with a fitting recess. The guide groove is formed on an outer circumferential face of the fitting recess. The male connector is configured so as to be engageable with another female connector with the rotating member for moving at least one of the male and female connectors in a fitting direction. The female connector includes a fitting protrusion for engagement with the fitting recess. The elastic sealing part is arranged on an outer circumferential face of the fitting protrusion to continuously adhere to an inner circumferential face of a fitting-side end portion of the fitting recess along the circumferential direction.

4 Claims, 9 Drawing Sheets

(56) References Cited

U.S. PATENT DOCUMENTS

| | | | | |
|---|---|---|---|---|
| 2006/0068625 | A1* | 3/2006 | Kim | H01R 13/5219 439/271 |
| 2008/0070435 | A1* | 3/2008 | Chen | H01R 13/5812 439/320 |
| 2012/0264322 | A1* | 10/2012 | Grek | H01R 13/622 439/320 |
| 2012/0329303 | A1* | 12/2012 | Fukano | H01R 33/9658 439/271 |
| 2013/0168150 | A1* | 7/2013 | Sakakura | H02G 3/22 174/650 |
| 2014/0080355 | A1* | 3/2014 | Wang | H01R 13/641 439/573 |
| 2014/0368069 | A1* | 12/2014 | Ren | H01R 13/622 310/71 |

* cited by examiner

CONNECTOR FITTING STRUCTURE

CROSS REFERENCE TO RELATED APPLICATION

The present application is based on, and claims priority from, Japan Application Serial Number 2013-186987, filed Sep. 10, 2013, the disclosure of which is hereby incorporated by reference herein in its entirety.

BACKGROUND

1. Technical Field

The present application relates to a connector fitting structure where a male connector, which is provided with a fitting recess and which has a guide groove (for a rotating member) formed on an outer circumferential face of the fitting recess so as to be engageable with a female connector having a rotating member, is fitted to a different female connector provided with no rotating member.

2. Related Art

For a fitting structure for a pair of male and female connectors for electrical connection with an automobile transmission, there exists a structure where movement of the pair of male and female connectors in a fitting direction is accomplished by rotating a rotating member, which is rotatably arranged on the female connector, while guiding the rotating member by a guide groove formed on an outer circumferential face of a fitting recess of the male connector (see JP2003-163056A (Patent Literature 1)).

In the meantime, a female connector which does not have such a rotating member (hereinafter, such a female connector will be referred to as "female connector with no rotating member") enables a number of components to be reduced due to an absence of the rotating member advantageously. However, the female connector with no rotating member is inferior to the female connector having the rotating member in terms of allowing female connector to be fitted to the male connector in a formal posture of female connector. Note, the female connector having the rotating member will be referred to as "female connector with the rotating member", hereinafter.

With use of a common male connector formed with a guide groove for the rotating member, therefore, it becomes easy to provide a connector fitting structure on request if only fitting the common male connector with use of both the female connector with no rotating member and the female connector with the rotating member.

SUMMARY

However, the connector fitting structure described in Patent Literature 1 has a problem as follows. That is, as illustrated in FIG. 1, if a female connector 300 with no rotating member is obliquely fitted to a male connector 200 formed with a guide groove 210, there is the possibility that the water sealing performance is degraded by a reduced compression face of an elastic sealing member 400, causing an invasion of liquid (e.g. water) into the connector through the guide groove 210 of the male connector 200.

Under such a situation, an object of the present invention is to provide a connector fitting structure which allows a male connector, which has a guide groove (for the rotating member) formed so as to be engageable with a female connector with a rotating member for moving at least one of male and female connectors in a fitting direction, and a female connector with no rotating member to be fitted to each other while ensuring the water sealing performance.

A connector fitting structure according to the present invention includes: a female connector with no rotating member, which is engageable with a male connector having a guide groove formed on an outer circumferential face of a fitting recess so that the male connector can be fitted to another female connector with a rotating member for moving at least one of the male and female connectors in a fitting direction, the female connector having a fitting protrusion formed for engagement with the fitting recess; and an elastic sealing part provided in the female connector with no rotating member and arranged on an outer circumferential face of the fitting protrusion to continuously adhere to an inner circumferential face of a fitting-side end portion of the fitting recess along a circumferential direction thereof.

With such a configuration, the elastic sealing part can be adhered to the inner circumferential face of the fitting-side end portion of the fitting recess formed with no guide groove. Additionally, even when the female connector with no rotating member is fitted to the male connector obliquely to the formal posture, it is possible to ensure the water sealing performance because the compressive face of the elastic sealing part is hard to be decreased. For this reason, the male connector, which is formed with the guide groove for the rotating member so as to be engageable with a female connector with the rotating member for moving at least one connector of the male and female connectors in pairs in the fitting direction, can be fitted to the female connector with no rotating member while ensuring the water sealing performance.

The connector fitting structure according to an aspect of the present invention may further includes a cover part formed integrally with the female connector with no rotating member, the cover part configured so as to cover an opening of a casing body accommodating the male connector and including a fixing part to be fixed to the casing body.

With such a configuration, by fixing the female connector with no rotating member to the casing body through the fixing part, it is possible to fit the female connector with no rotating member to the male connector while suppressing an inclination of the female connector.

An axial length of the elastic sealing part may be adjusted so that the elastic sealing part is partially positioned above a marginal face of the fitting recess.

With such a configuration, as the elastic sealing part is partially positioned above the marginal face (as an invasion inlet of water etc.) of the fitting-side end portion of the fitting recess, it is possible to enhance the water sealing performance of the fitting recess in the circumference of the fitting-side end portion.

DETAILED DESCRIPTION

Figure 1A:
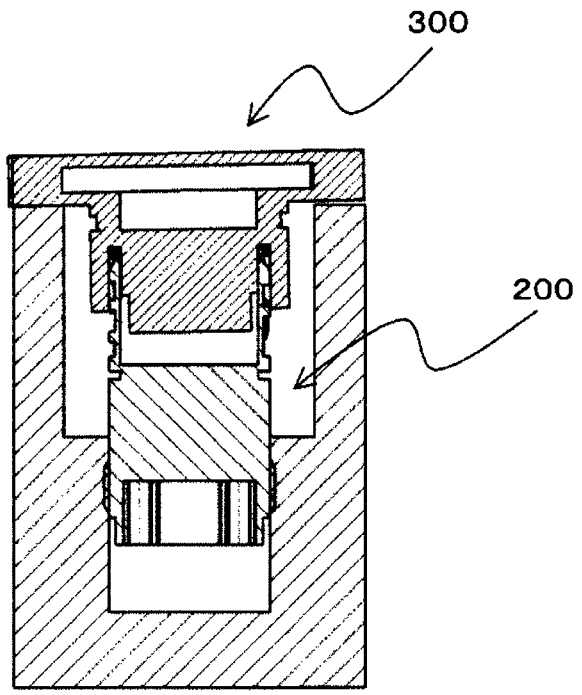
FIG. 1A PRIOR ART
FIG. 1A is a sectional view of a connector fitting structure in a conventional example.
Figure 1B:
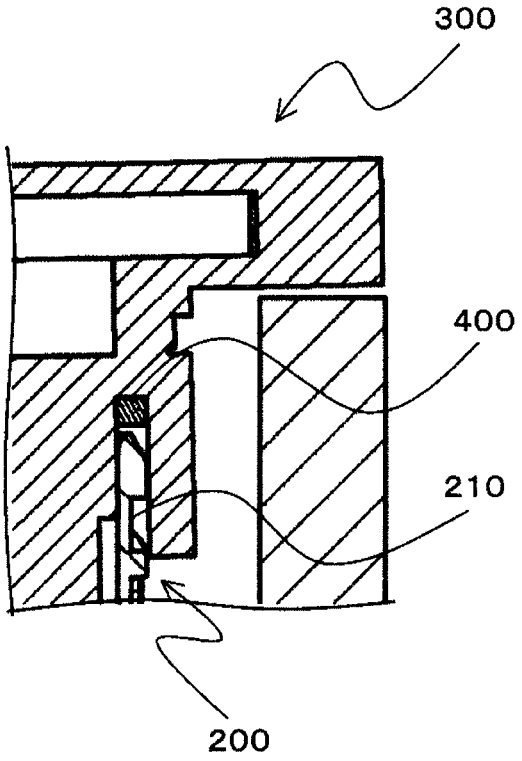
FIG. 1B PRIOR ART
FIG. 1B is a view enlarging the periphery of one end (on the fit-in side) of a male terminal of FIG. 1A.
Figure 2:
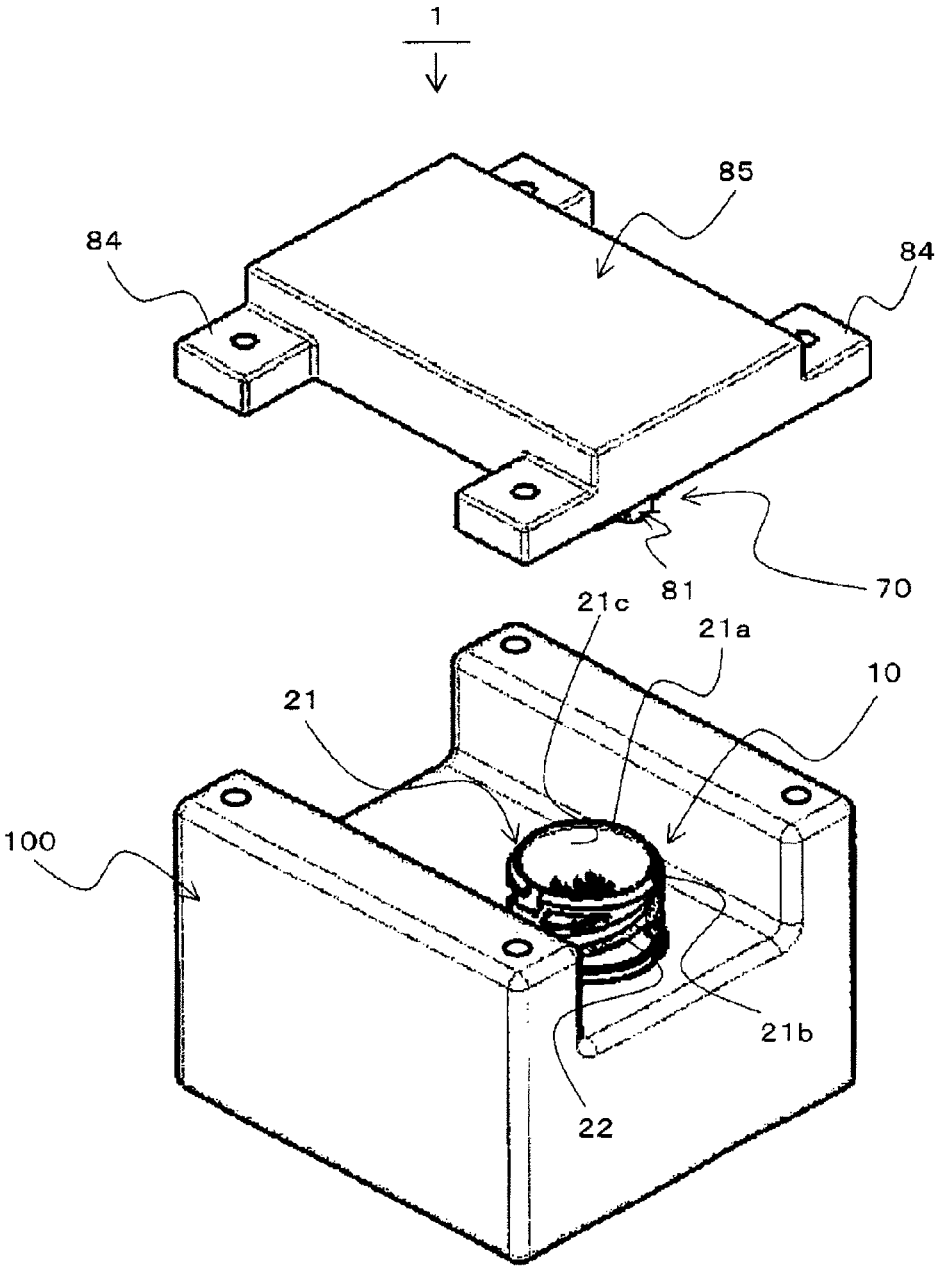
FIG. 2 is a perspective view illustrating one condition of a connector fitting structure according to an embodiment before fitting a female connector with no rotating member to a male connector.

A connector fitting structure 1 according to an embodiment will be described with reference to FIGS. 2 to 10, below.

For instance, the connector fitting structure 1 according to the embodiment is provided for electrical connection with an automobile transmission. Specifically, the connector fitting structure 1 is provided to fit a male connector 10 to a female connector 70 with no rotating member. The male connector 10 is provided with a fitting recess 21 and has a guide groove 22 formed on an outer circumferential face 21*b* of the fitting recess 21. The guide groove 22 is provided for a rotating member 60 of a female connector 30 different from the above female connector 70. Concretely, in the male connector 10, the guide groove 22 is intended to engage with the rotating member 60 of the female connector 30. Note, the rotating member 60 is provided for moving at least one of the male and female connectors in a fitting direction.

Note, in the embodiment, the male connector 10 is fixed to a casing body 100 under condition that the male connector 10 is accommodated in the casing body 100. Therefore, the male and female connectors in pairs are adapted so as to engage with each other by moving either the female connector 30 with the rotating member or the female connector 70 with no rotating member in the fitting direction.

Additionally, when the female connector 30 with the rotating member is not distinguished from the female connector 70 with no rotating member in the following description, each of these female connectors 30, 70 will be generically referred to as "female connector", below.

First, the male connector 10 will be described below.

For common use, the male connector 10 is configured so as to be engageable with both of the female connector 30 with the rotating member and the female connector 70 with no rotating member. The male connector 10 retains a plurality of male terminals 11 in a cylindrical male connector housing 20 made from insulating material, such as synthetic resin. The male terminals 11 are connectable with a plurality of female terminals 12 of the female connector 30 with the rotating member or those of the female connector 70 with no rotating member.

The male connector housing 20 is formed with an fitting recess 21 having an inside partition wall (not illustrated) providing a bottom face. The fitting recess 21 holds respective male terminals 11 so that their tab-shaped connecting portions project from the inside partition wall toward a fitting port into which the female connectors 30, 70 are fitted.

Figure 8:
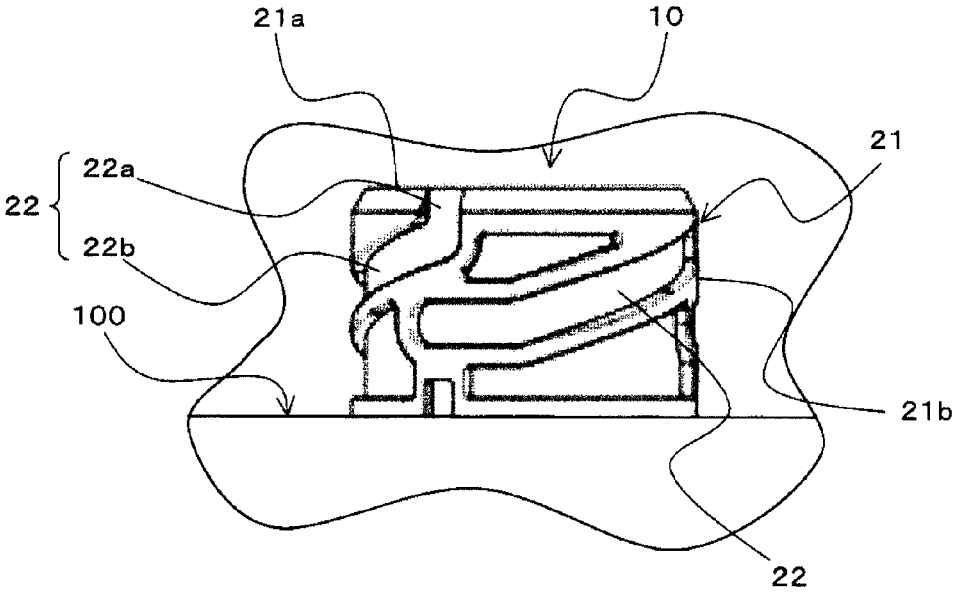
FIG. 8 is an enlarged perspective view of the periphery of a fitting port of the male connector.

The guide groove 22, which is formed on the outer circumferential face of the fitting recess 21, serves to guide the movement of the female connector 30 with the rotating member 60 in the fitting direction since the rotating member 60 is rotated under condition that a guide projection 61*a* of the rotating member 60 is engaged in the guide groove 22. More specifically, as illustrated in FIG. 8, the guide groove 22 includes a straight guide groove part 22*a* and an inclined guide groove part 22*b* connected to an end of the straight guide groove part 22*a* successively. The straight guide groove part 22*a* is formed so as to linearly extend from a marginal face 21*a* of the fitting recess 21 in the fitting direction. The inclined guide groove part 22*b* is formed so as to extend in the circumferential direction, spiraling obliquely.

The straight guide groove part 22*a* is a groove which guides the female connector 30 with the rotating member into its initial fitting condition with the male connector 10 by allowing the guide projection 61*a* of the rotating member 60 to be engaged in the straight guide groove part 22*a* . By allowing the rotating member 60 to be engaged in the straight guide groove part 22*a* , the female connector 30 with the rotating member can be fitted to the male connector 10 while maintaining its formal posture against the male connector 10.

The inclined guide groove part 22*b* is a groove which guides rotation of the rotating member 60 to move the female connector 30 with the rotating member in the fitting direction, from the initial fitting condition up to a fitting completing position. That is, by rotating the rotating member 60 where the guide projection 61*a* moves up to a terminal position of the straight guide groove part 22*a* , the inclined guide groove part 22*a* guides the female connector 30 with the rotating member in the fitting direction, from the initial fitting condition up to the fitting completing position. Note, the total dimension of the straight guide groove part 22*a* and the inclined guide groove part 22*b* in the fitting direction is equal to a moving distance of the female connector 30 with the rotating member, which travels in the fitting direction from the beginning of fitting to the completion of fitting.

Next, the rotating member 30 with the rotating member will be described below.

The female connector 30 with the rotating member includes a cylindrical female connector housing 40 made from insulating material, such as synthetic resin, and the rotating member 60 arranged to be rotatable to the female connector housing 40.

The female connector housing 40 includes a plurality of terminal accommodating chambers 42 for accommodating a plurality of female terminals 12 to be connected to the male terminals 11 of the male connector 10 as the fitting mate. The female connector housing 40 includes a fitting protrusion 41 formed with an outer diameter somewhat smaller than the inner diameter of the fitting recess 21 so as to be fitted in the fitting recess 21 from a front end to rearward of the fitting protrusion 41. The female connector housing 40 is provided, at its rear end, with a seal wall part 43 which encloses the outer circumferential face of the male connector housing 20 around the fitting port through a gap.

Also, the female connector housing 40 is provided, on the outer circumferential face 41*a* of the fitting protrusion 41, with an elastic sealing part 50 which adheres to an inner circumferential face 21*c* of a fitting-side end portion of the fitting recess 21 along the circumferential direction successively. The elastic sealing part 50 includes a seal arranging groove 51 formed on the outer circumferential face of the rear end of the fitting protrusion 41 along the circumferential direction and an annular elastic sealing member 52 arranged in the seal arranging groove 51.

The elastic sealing member 52 is made from an elastic material, such as rubber, and has valleys and peaks alternately formed in the axial direction successively, providing so-called "lips" configuration. A thickness of the elastic sealing member 52 is adjusted so that it adheres to both the outer circumferential face 41*a* of the fitting protrusion 41 and the inner circumferential face 21*c* of the fitting-side end portion of the fitting recess 21 in the compressed manner. Note, without being limited to the above "lips" configuration, the elastic sealing member 52 may be provided with any other configurations as long as it can adhere to the outer circumferential face 41*a* of the fitting protrusion 41 and the inner circumferential face of the fitting-side end portion of the fitting recess 21 in the sealed state. For instance, it may be an annular elastic member having a constant thickness.

In the embodiment, the axial length of the elastic sealing member 50 is adjusted so that it spreads above the marginal face 21*a* of the fitting recess 21.

The rotating member 60 includes a small-diameter cylindrical part 61 arranged on an axially-front side in the fitting direction and a large-diameter cylindrical part 62 arranged behind the small-diameter cylindrical part 61 successively in the fitting direction and having a diameter larger than that of the small-diameter cylindrical part 61.

The small-diameter cylindrical part 61 has an inner diameter adjusted so as to be somewhat larger than an inner diameter of the leading end of the fitting recess 21 of the male connector housing 20. The small-diameter cylindrical part 61 includes a plurality of guide projections 61*a* arranged at predetermined intervals along the circumferential direction of the inner circumferential face of the cylindrical part 61.

The large-diameter cylindrical part 62 has an inner diameter adjusted so as to get somewhat larger than the outer diameter of the seal wall part 43. The large-diameter cylindrical part 62 includes a plurality of engagement pieces 62*a* which rotatably engage the rotating member 60 in engagement grooves 44 formed at several positions along the outer circumference of the female connector housing 40.

The female connector 30 with the rotating member is fitted to the male connector 10 in the formal posture since the female connector 30 is supported by the rotating member 60.

Next, the female connector 70 having no rotating member will be described below.

The female connector 70 with no rotating member includes a cylindrical female connector housing 80 made from an insulating material, such as synthetic resin.

The female connector housing 80 includes a plurality of terminal accommodating chambers 82 for accommodating a plurality of female terminals 12 to be connected to a plurality of male terminals 11 of the male connector 10 as the fitting mate. The female connector housing 80 includes a fitting protrusion 81 formed with an outer diameter somewhat smaller than the inner diameter of the fitting recess 21 so as to be fitted in the fitting recess 21 of the male connector 10 from a front end to rearward of the fitting protrusion 81. The female connector housing 80 is provided, at its rear end, with a seal wall part 83 which encloses the outer circumferential face of the male connector housing 20 around the fitting port through a gap.

The female connector housing 80 is provided, on the outer circumferential face of the fitting protrusion 81, with an elastic sealing part 90 which adheres to the inner circumferential face 21*c* of the fitting-side end portion of the fitting recess 21 along the circumferential direction successively.

The elastic sealing part 90 includes a seal arranging groove 91 formed on the outer circumferential face of the rear end of the fitting protrusion 91 along the circumferential direction and an annular elastic sealing member 92 arranged in the seal arranging groove 91. The elastic sealing member 92 is made from an elastic material, such as rubber, and has valleys and peaks alternately formed in the axial direction successively, providing so-called "lips" configuration. A thickness of the elastic sealing member 92 is adjusted so that it adheres to both the outer circumferential face 81*a* of the fitting protrusion 81 and the inner circumferential face 21*c* of the fitting-side end portion of the fitting recess 21 in the compressed manner. Note, without being limited to the above "lips" configuration, the elastic sealing member 92 may be provided with any other configurations as long as it can adhere to the outer circumferential face 81*a* of the fitting protrusion 81 and the inner circumferential face 21*c* of the fitting-side end portion of the fitting recess 21 in the sealed state. For instance, it may be an annular elastic member having a constant thickness.

In the embodiment, the axial length of the elastic sealing part 90 is adjusted so that it spreads above the marginal face 21*a* of the fitting recess 21.

The female connector housing 80 is integrally provided with a cover part 85 which covers an opening of a casing body 100 accommodating the male connector 10 and contains fixing parts 84 for fixing the cover part 85 to the casing body 100.

The cover part 85 is fixed to the casing body 100 by mounting the fixing parts 84 on marginal faces of the opening of the casing body 100 and subsequently inserting screws etc. into through-holes formed in the fixing part 84. By fixing the cover part 85 to the casing body 100 in this way, the female connector 70 with no rotating member is fitted to the male connector 10 while suppressing an inclination of the female connector 70 with no rotating member.

Figure 9A:
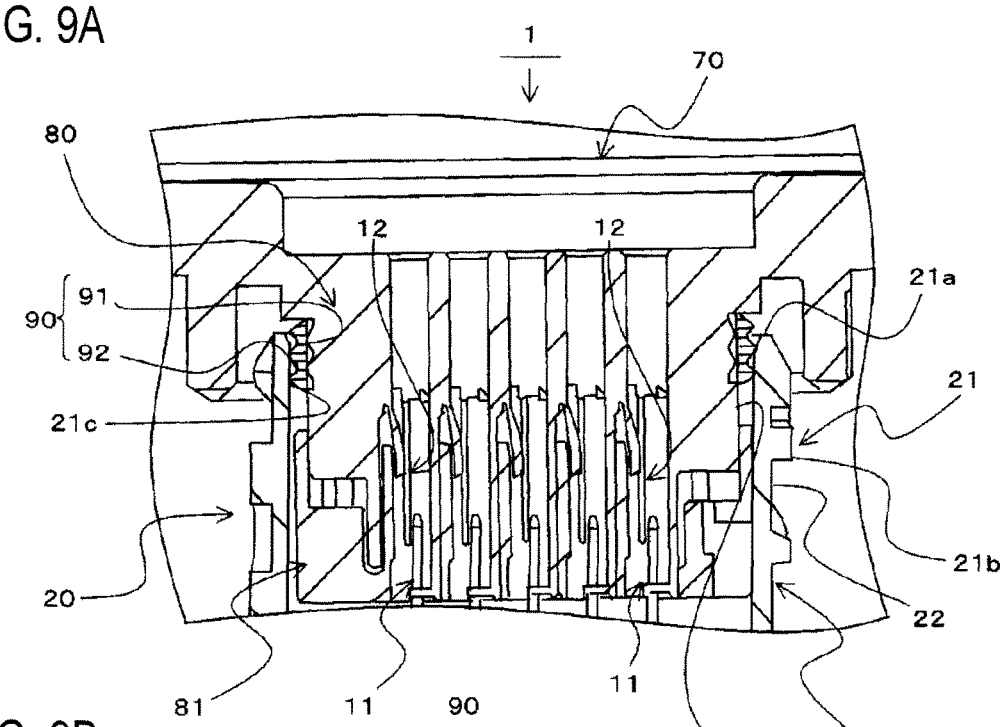
FIG. 9A is a sectional view illustrating a condition where the female connector with no rotating member is obliquely fitted to the male connector.
Figure 9B:
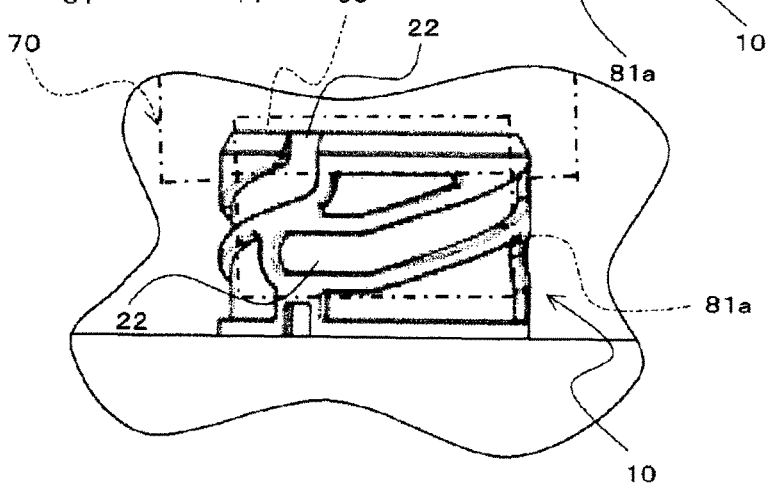
FIG. 9B is a view schematically illustrating the positional relationship between the male connector and an elastic sealing part under the condition of FIG. 9A (the female connector with no rotating member is indicated with an imaginary line).

In the connector fitting structure 1 established between the female connector 70 with no rotating member and the male connector 10, as illustrated in FIG. 9, even if the female connector 70 with no rotating member is fitted to the male connector 10 obliquely to the formal posture, the compressive face of the elastic sealing part 90 is hard to be decreased. Moreover, as the elastic sealing member 92 is adapted so as to adhere to the inner circumferential face 21*c* of the fitting-side end portion where the guide groove 22 is not formed, the female connector 70 with no rotating member is easy to adhere to the inner circumferential face 21*c* of the fitting-side end portion.

Figure 3:
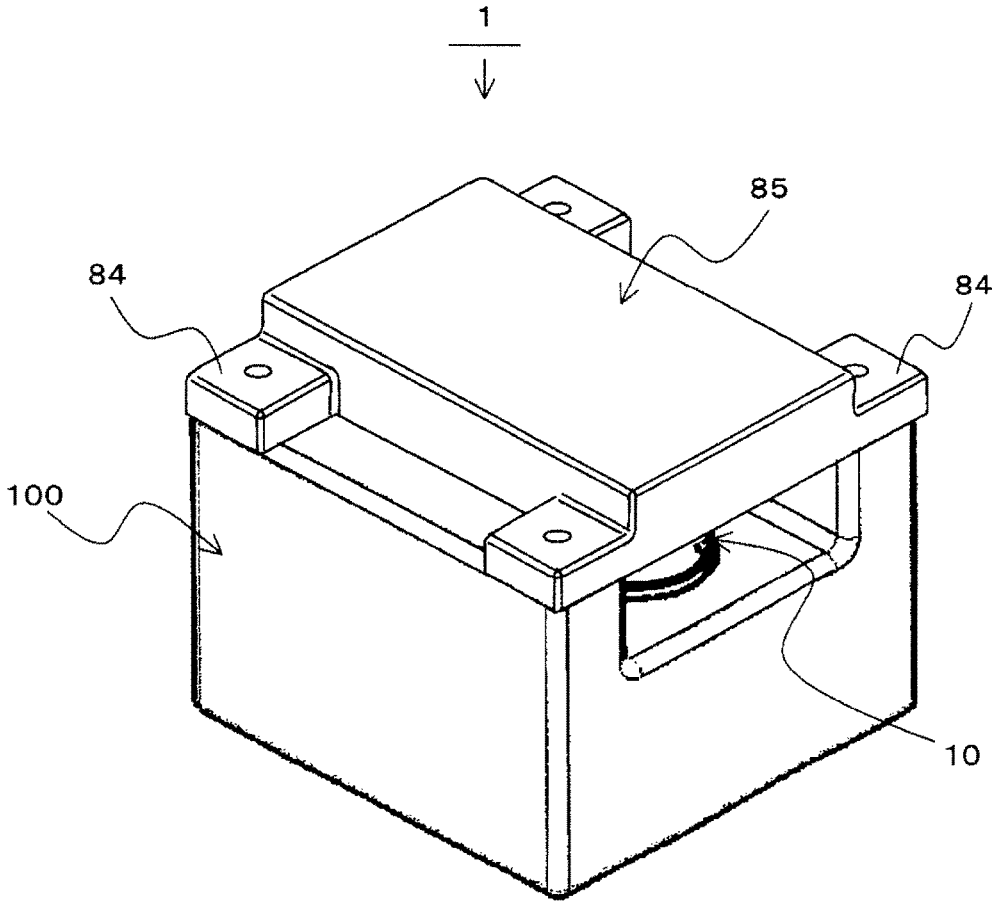
FIG. 3 is a perspective view illustrating another condition of the connector fitting structure according to the embodiment after fitting the female connector with no rotating member to the male connector.
Figure 4:
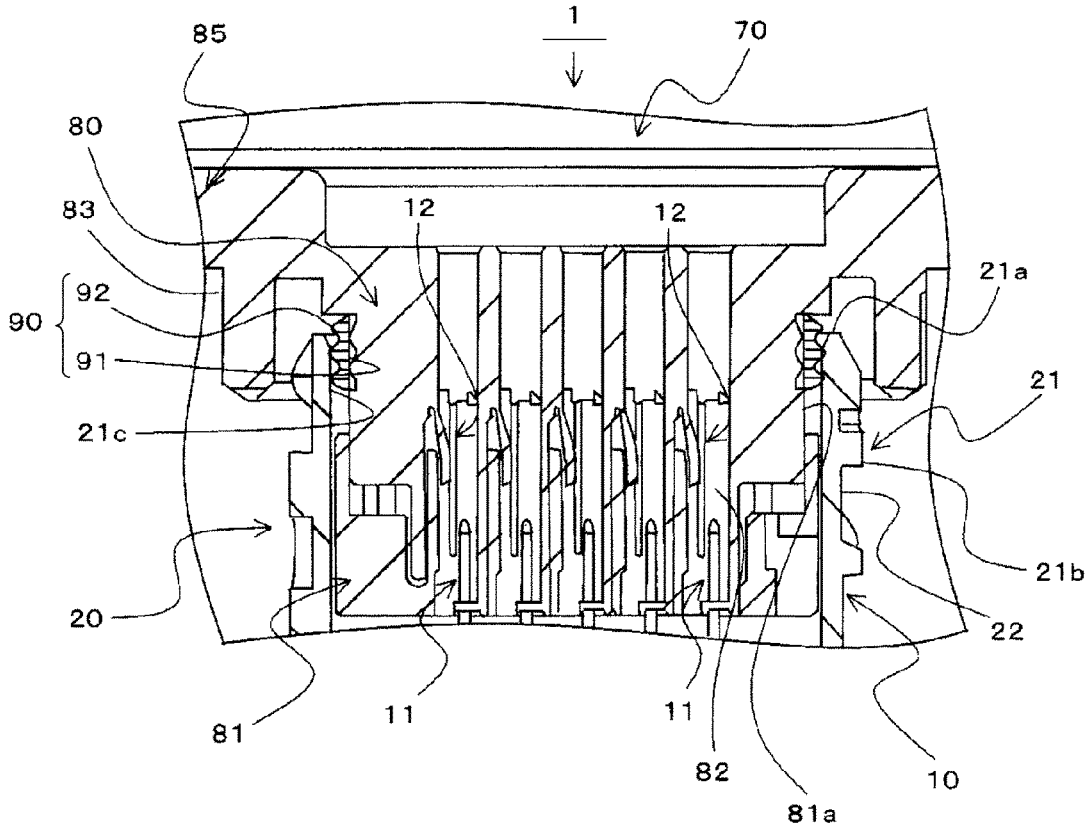
FIG. 4 is a sectional view of the connector fitting structure of FIG. 2.
Figure 5:
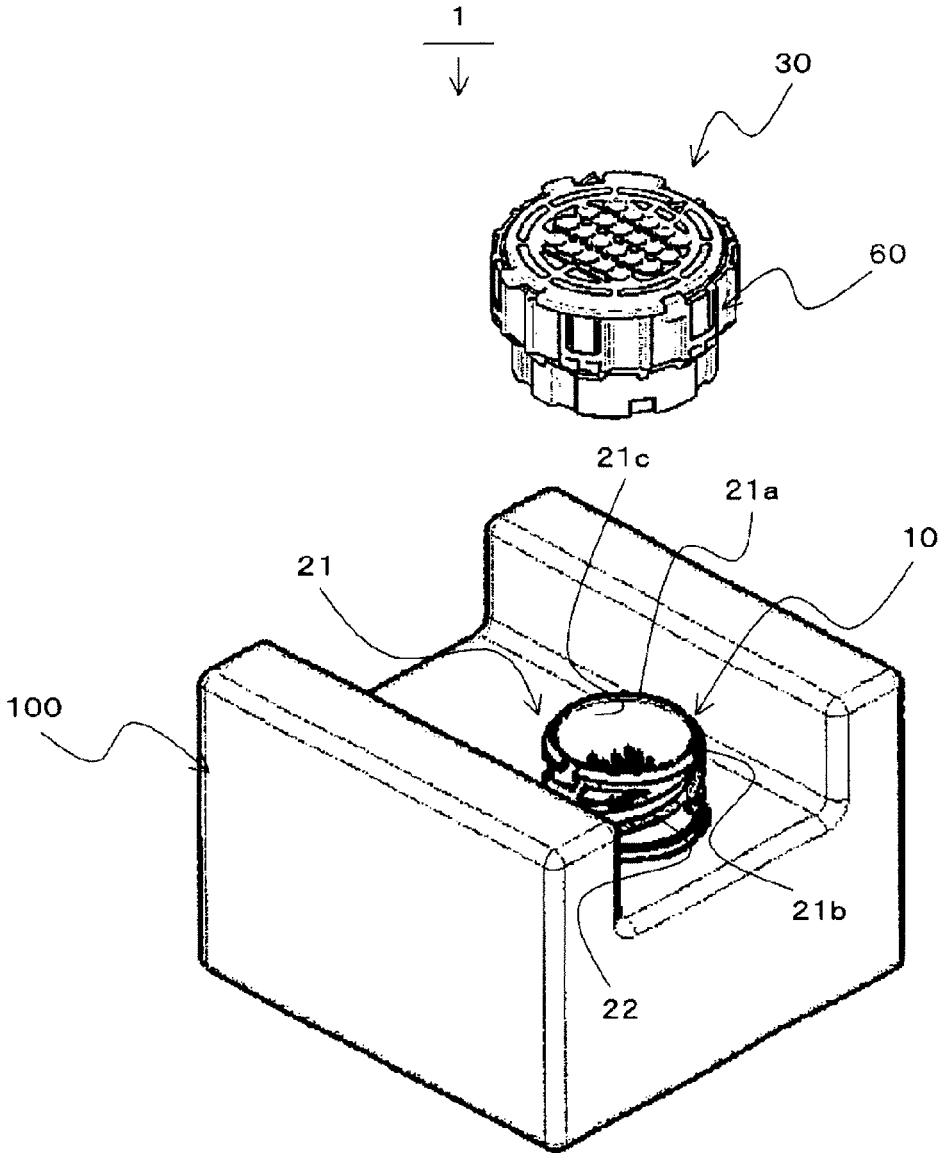
FIG. 5 is a perspective view illustrating one condition of the connector fitting structure according to the embodiment before fitting a female connector with a rotating member to the male connector.
Figure 6:
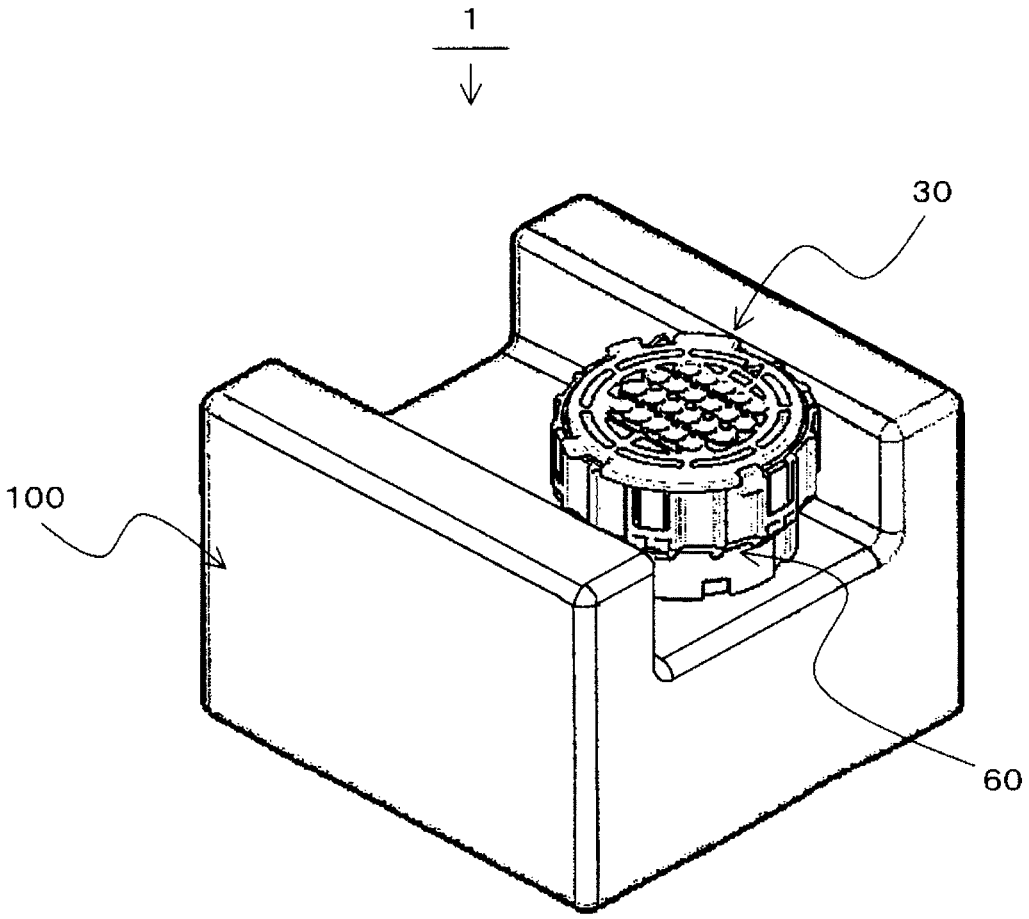
FIG. 6 is a perspective view illustrating another condition of the connector fitting structure according to the embodiment after fitting the female connector with the rotating member to the male connector.
Figure 7:
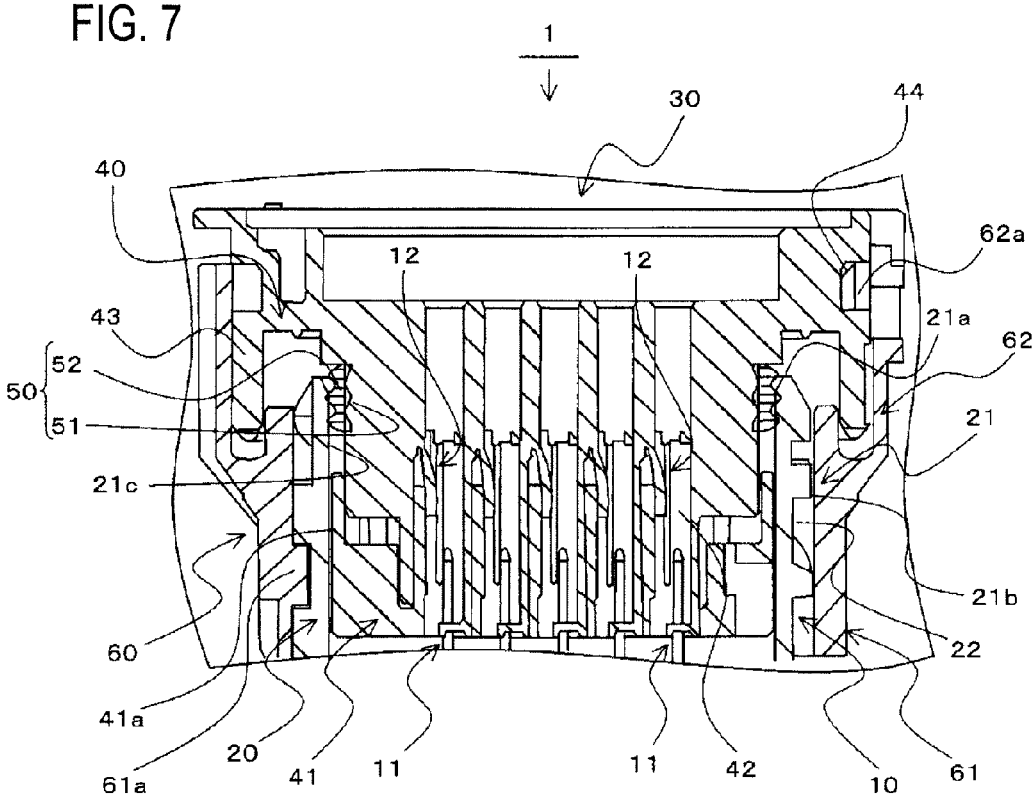
FIG. 7 is a sectional view of the connector fitting structure of FIG. 6.

As illustrated in FIG. 3, by fixing the female connector 70 with no rotating member to the casing body 100, it is possible to allow the female connector 70 with no rotating member to be fitted to the male connector 10 while suppressing an inclination of the female connector 70.

In the connector fitting structure 1 according to the embodiment, as the elastic sealing part 90 certainly adheres to the inner circumferential face 21*c* of the fitting-side end portion where the guide groove 22 is not formed, and the compressive face of the elastic sealing part 90 is hard to be decreased even if the female connector 70 with no rotating member is fitted to the male connector 10 obliquely to the formal posture, it is possible to ensure the water sealing performance of the connector fitting structure 1. Therefore, the male connector 10, which has the guide groove 22 for the rotating member 60 formed so as to be engageable with the female connector 30 having the rotating member 60 for moving at least one of male and female connectors in pairs in the fitting direction, can be fitted to the female connector 70 which does not have the rotating member 60 while ensuring the water sealing performance of the connector fitting structure 1.

By fixing the female connector 70 with no rotating member to the casing body 100 through the fixing parts 80, the connector fitting structure 1 according to the embodiment enables the female connector 70 with no rotating member to be fitted to the male connector 10 while suppressing an inclination of the female connector 70.

The connector fitting structure 1 according to the embodiment can enhance the water sealing performance of the circumference of the fitting-side end portion of the fitting recess 21 since the elastic sealing part 90 is partially positioned above the marginal face 21*a* (as an invasion inlet of water etc.) of the fitting-side end portion of the fitting recess 21.

Figure 10:
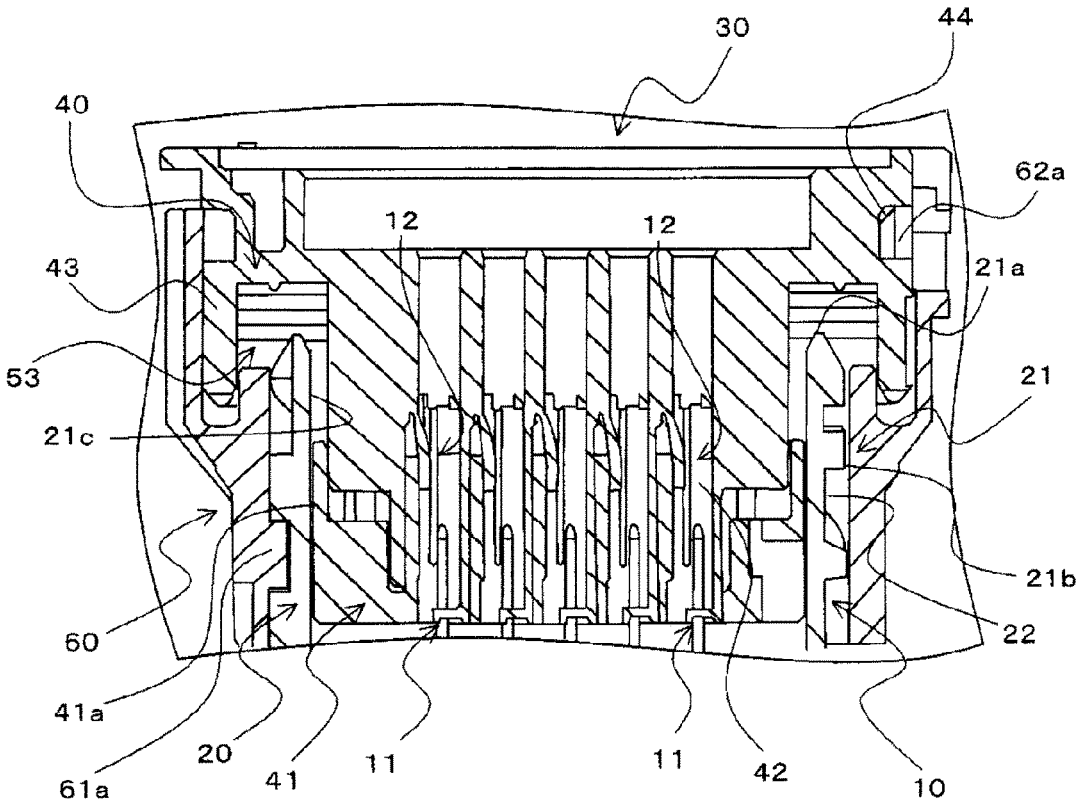
FIG. 10 is a sectional view of the female connector with the rotating member in a modification example.

Although the connector fitting structure 1 according to the embodiment has been illustrated by an example of the female connector 30 (having the rotating member) having the elastic sealing part 50 arranged on the outer circumferential face 41*a* of the fitting protrusion 41 to adhere to the inner circumferential face 21*c* of the fitting-side end portion of the fitting recess 21 along the circumferential direction, the female connector 30 is not limited only to this configuration. Thus, as illustrated in FIG. 10, the female connector 30 with the rotating member may be provided with an elastic sealing part 53 which adheres to the fitting-side end portion of the male connector 10.

Although the connector fitting structure 1 according to the embodiment has been illustrated by an example of the female connector 70 (with no rotating member) formed integrally with the cover part 85, the female connector 70 is not limited only to this configuration. Thus, the female connector 70 (with no rotating member) may be provided independently of the cover part 85.

Although the present invention has been described on the ground of embodiments, the present invention is not limited only to the above-mentioned embodiments and therefore, it may be modified without any departure from the gist of the invention.

What is claimed is:

1. A connector fitting structure, comprising:

a female connector with no rotating member, which is engageable with a male connector having a guide groove formed on an outer circumferential face of a fitting recess so that the male connector can be fitted to another female connector with a rotating member for moving at least one of the male and female connectors in a fitting direction, the female connector with no rotating member comprising a fitting protrusion formed for engagement with the fitting recess; and an elastic sealing part provided in the female connector with no rotating member and arranged on an outer circumferential face of the fitting protrusion to continuously adhere to an inner circumferential face of a fitting-side end portion of the fitting recess along a circumferential direction thereof, wherein the elastic sealing part includes a seal arranging groove formed on the outer circumferential face of the fitting protrusion along the circumferential direction and an annular elastic sealing member arranged in the seal arranging groove, the annular elastic sealing member has valleys and peaks formed on an outer circumferential face of the annular elastic sealing member, these valleys and peaks being alternately formed in an axial direction of the elastic sealing part, the seal arranging groove has valleys and peaks formed on a bottom face of the seal arranging groove, these valleys and peaks being alternately formed in the axial direction of the elastic sealing part, and the guide groove of the male connector comprises a straight guide groove part and an inclined guide groove part.

2. The connector fitting structure of claim 1, further comprising a cover part formed integrally with the female connector with no rotating member, the cover part configured so as to cover an opening of a casing body accommodating the male connector, and including a fixing part to be fixed to the casing body.

3. The connector fitting structure of claim 1, wherein an axial length of the elastic sealing part is adjusted so that the elastic sealing part is partially positioned above a marginal face of the fitting recess.

4. The connector fitting structure of claim 1, wherein the fitting recess comprises a bottom face configured to hold a plurality of male terminals such that connecting portions of the plurality of male terminals protrude into the fitting recess.

* * * * *